US006672101B2

(12) United States Patent
Gennami et al.

(10) Patent No.: US 6,672,101 B2
(45) Date of Patent: Jan. 6, 2004

(54) ELECTRICALLY DRIVEN COMPRESSORS AND METHODS FOR CIRCULATING LUBRICATION OIL THROUGH THE SAME

(75) Inventors: Hiroyuki Gennami, Kariya (JP); Kazuhiro Kuroki, Kariya (JP); Ken Suitou, Kariya (JP); Naohiro Nakajima, Kariya (JP); Shinji Tsubai, Kariya (JP); Kazuya Kimura, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/105,606

(22) Filed: Mar. 25, 2002

(65) Prior Publication Data

US 2002/0134101 A1 Sep. 26, 2002

(30) Foreign Application Priority Data

Mar. 26, 2001 (JP) ..... 2001-088166
Mar. 26, 2001 (JP) ..... 2001-088168
Mar. 30, 2001 (JP) ..... 2001-100085

(51) Int. Cl.[7] ..... F25B 43/02; F01M 1/00; F01M 3/00; F01C 1/02; F01C 21/04; F01C 21/06

(52) U.S. Cl. ..... 62/469; 184/6.16; 184/6.18; 418/55.6; 418/91; 418/92; 418/93; 418/94

(58) Field of Search ..... 62/469; 184/6.16, 184/6.18; 418/55.6, 97, 92, 93, 94

(56) References Cited

U.S. PATENT DOCUMENTS 3,986,799 A * 10/1976 McCullough ..... 418/55.2
3,988,080 A * 10/1976 Takada ..... 418/76
4,538,975 A * 9/1985 Tsukagoshi ..... 418/55.6
4,623,306 A * 11/1986 Nakamura et al. ..... 418/55.6
4,762,477 A * 8/1988 Hayano et al. ..... 418/1
5,678,986 A * 10/1997 Terauchi et al. ..... 418/55.6
5,947,709 A * 9/1999 Koyama et al. ..... 418/55.6
6,135,739 A * 10/2000 Ogawa et al. ..... 418/55.5
6,152,713 A * 11/2000 Hisanaga et al. ..... 418/55.2
6,494,696 B2 * 12/2002 Terai et al. ..... 418/55.6

FOREIGN PATENT DOCUMENTS

JP 58-117380 7/1983
JP 06002685 A * 1/1994 ..... F04C/29/02

* cited by examiner

*Primary Examiner*—William C. Doerrler
*Assistant Examiner*—Filip Zec
(74) *Attorney, Agent, or Firm*—Woodcock Washburn LLP

(57) ABSTRACT

An oil storage area (45*a*) is defined on the bottom of a motor chamber (45) of a scroll compressor (1). An oil transfer route (4*a*) is defined in the portion of a center housing (4) that corresponds to the storage area (45*a*). Lubricating oil L is separated from the discharged, compressed refrigerant by an oil separator (80) and the lubricating oil L is supplied to the backside of a movable scroll (20) due to a pressure differential within the compress (1). After lubricating a bearing (10), the lubricating oil L is temporarily stored in the storage area (45*a*) and then is transferred due to a pressure differential to the suction-side of a compression mechanism (21) via the oil transfer route (4*a*). The lubricating oil L is then transferred to the oil separator (80) together with the compressed refrigerant that is discharged from a compression chamber (32) of the compression mechanism (21). Thus, the lubricating oil L contained in the discharged, compressed refrigerant can be effectively separated from the compressed refrigerant and circulated to and from the back side of the movable scroll (20) in order to lubricate moving parts within the compressor (1) using the pressure differentials within the compressor (1).

16 Claims, 3 Drawing Sheets

ELECTRICALLY DRIVEN COMPRESSORS AND METHODS FOR CIRCULATING LUBRICATION OIL THROUGH THE SAME

BACKGROUND OF THE INVENTION

1. Field of the Invention

The present invention relates to compressors driven by an electric motor as the drive source and methods for lubricating the same.

2. Description of Related Art

Japanese Laid-open Patent Publication No. 5-313156 discloses a general scroll compressor that is used as a rotary compressor for an air conditioner, refrigerator, or the like. This scroll compressor is configured such that a movable scroll rotates or orbits relative to a fixed scroll in order to compress a refrigerant to a high pressure within a compression chamber defined between the fixed scroll and the movable scroll. The compressed refrigerant is then discharged from a discharge port defined in the fixed scroll.

In such a scroll compressor, a bearing mechanism for rotatably supporting the drive shaft is conventionally installed on the back of the movable scroll. The bearing mechanism can be lubricated, for example, by supplying lubricating oil to this bearing mechanism. However, Japanese Laid-open Patent Publication No. 5-313156 does not suggest any specific technique for supplying lubricating oil to the bearing mechanism.

SUMMARY OF THE INVENTION

Therefore, one object of the present teachings is to provide improved electrically driven compressors that can efficiently lubricate the compressor, including drive shaft bearings disposed therein, using lubricating oil and lubrication methods therefor.

In one of the aspect of the present teachings, electrically driven compressors are taught that utilize pressure difference within a refrigerant channel, which pressure difference occurs between the discharge side and the drive shaft bearing during operation, for circulating lubricating oil to the bearing.

According to another aspect of the present teachings, electric compressors may include a compression mechanism for compressing the refrigerant. A drive shaft is coupled to the compression mechanism and the drive shaft is rotatably driven by an electric motor. Therefore, when the electric motor is activated, the introduced refrigerant is compressed to a high pressure by the compression mechanism and the compressed refrigerant is then discharged. The compression mechanism may comprise, for example, a scroll compressor that compresses the refrigerant by rotating a movable scroll relative to a fixed scroll, a reciprocal compressor that compresses the refrigerant by reciprocating a piston inside a cylinder bore, or other compressor designs.

A motor chamber houses (encloses) the electric motor and is preferably almost completely sealed. This motor chamber may be connected via a communication path to a refrigerant flow channel, which refrigerant flow channel leads from the refrigerant suction port of the compressor to the refrigerant discharge port of the compressor. Consequently, a portion of the refrigerant moving through the refrigerant flow channel reaches a so-called "stagnated state" within the motor chamber. Moreover, if a pressure difference exists between the refrigerant flow channel and the motor chamber, the refrigerant will move so as to equalize the pressure difference. In this case, heat transfer occurs between the refrigerant within the refrigerant flow channel and the refrigerant within the motor chamber, thereby cooling the electric motor disposed inside the motor chamber. During this process, the amount of refrigerant that serves to cool the electric motor is only a small portion of the total amount of refrigerant that is moving through the refrigerant flow channel. Thus, this technique has little effect on the compression work being performed by the compressor.

The compressors may further include a lubricating oil supply route and a lubricating oil transfer route. Using the pressure difference within the compressor, the lubricating oil may be supplied via the lubricating oil supply route from the discharge region, e.g., lubricating oil that has been separated from the compressed refrigerant using an oil separator, to the area proximal to the drive shaft bearing (hereinafter also referred to as the "bearing mechanism region"). Because the pressure of the lubricating oil within the discharged refrigerant is higher than the pressure within the area proximal to the drive shaft bearing, by providing a route that connects the discharge region to the bearing mechanism region, the lubricating oil within the discharged refrigerant can be easily supplied to the bearing mechanism using the pressure difference. The lubricating oil supplied to the bearing mechanism (drive shaft bearing) then lubricates the bearing mechanism. When the lubricating oil is being supplied to the bearing mechanism, a portion of the discharged refrigerant may move to the bearing mechanism together with the lubricating oil, thereby raising the pressure at the bearing mechanism region.

The lubricating oil transfer route is a route or path for transferring the lubricating oil that has been supplied to the bearing mechanism region, to the suction-side region using the pressure difference. The lubricating oil transfer route is preferably formed in the portion of the housing that separates an oil storage area on the motor chamber side from the suction-side region. The discharged refrigerant that enters the bearing mechanism region via the lubricating oil supply route together with the lubricating oil pressurizes the bearing mechanism region. Consequently, a pressure difference occurs between the bearing mechanism region and the suction-side region of the compressor. Therefore, by connecting the bearing mechanism region to the portion of the suction-side region that has a lower pressure than the bearing mechanism via the lubricating oil transfer route, the lubricating oil disposed in the bearing mechanism region is easily transferred to the suction-side region of the compressor based on the pressure difference.

The "suction-side region" referred to herein includes the suction region immediately in front of the location where the introduced refrigerant is guided into the compression mechanism, as well as, e.g., a compression chamber, etc. used for compressing the introduced refrigerant in a scroll compressor. That is, the bearing mechanism region can be connected to the low-pressure side of the compression chamber (a location that has a lower pressure than the bearing mechanism region) by means of the lubricating oil transfer route. The lubricating oil thus transferred to the suction-side region via the lubricating oil transfer route is returned to the suction-side region by the compression action of the compression mechanism. In other words, this lubricating oil is discharged from the compression mechanism together with the discharged refrigerant. The lubricating oil in this discharge-side region is supplied to the bearing mechanism again via the lubricating oil supply route. The lubricating oil in the discharge-side region is circulated via the lubricating oil supply route and lubricating oil transfer route, both of which may have relatively simple configurations. Therefore, such compressors are efficient because the lubricating oil contained in the refrigerant can be effectively circulated to lubricate moving parts within the compressor. Moreover, the lubricating oil can be easily circulated using pressure differences of the refrigerant within the compressor.

In another aspect of the present teachings, compressor may include an oil storage area for storing the lubricating oil that has been transferred to the bearing mechanism region via the lubricating oil supply route. In other words, this oil storage area may be a region or space for storing the lubricating oil that has been used to lubricate the bearing mechanism or the excess lubricating oil that has been supplied to the bearing mechanism. This oil storage area preferably may be provided, e.g., on the bottom of the motor chamber. In that case, the lubricating oil that has fallen from the bearing mechanism toward the bottom of the motor chamber due to gravity can be stored in the oil storage area, which may have a relatively simple configuration. Furthermore, the lubricating oil that has been stored in the oil storage area can be reliably transferred to the suction-side region via the lubricating oil transfer route. Therefore, the lubricating oil can be reliably circulated using a relatively simple configuration.

In another aspect of the present teachings, methods are taught for circulating lubricating oil through an electrically driven compressor. Such methods may include circulating lubricating oil by supplying the lubricating oil from the discharge-side region of the compressor to the bearing mechanism, then transferring the lubricating oil to the suction-side region of the compressor, and finally returning the lubricating oil to the discharge-side region again. These operations may be all performed using the pressure differences in the refrigerant along the refrigerant flow path or route. Therefore, the lubricating oil can be easily circulated using differences in refrigerant pressure.

Such methods may preferably further include storing the lubricating oil before it is transferred from the bearing mechanism region to the suction-side region. Then, the stored lubricating oil may be transferred from the bearing mechanism region to the suction-side region. Therefore, the lubricating oil can be reliably circulated using such methods.

Additional objects, features and advantages of the present invention will be readily understood after reading the following detailed description together with the accompanying drawings and the claims.

DETAILED DESCRIPTION OF THE INVENTION

Figure 1:
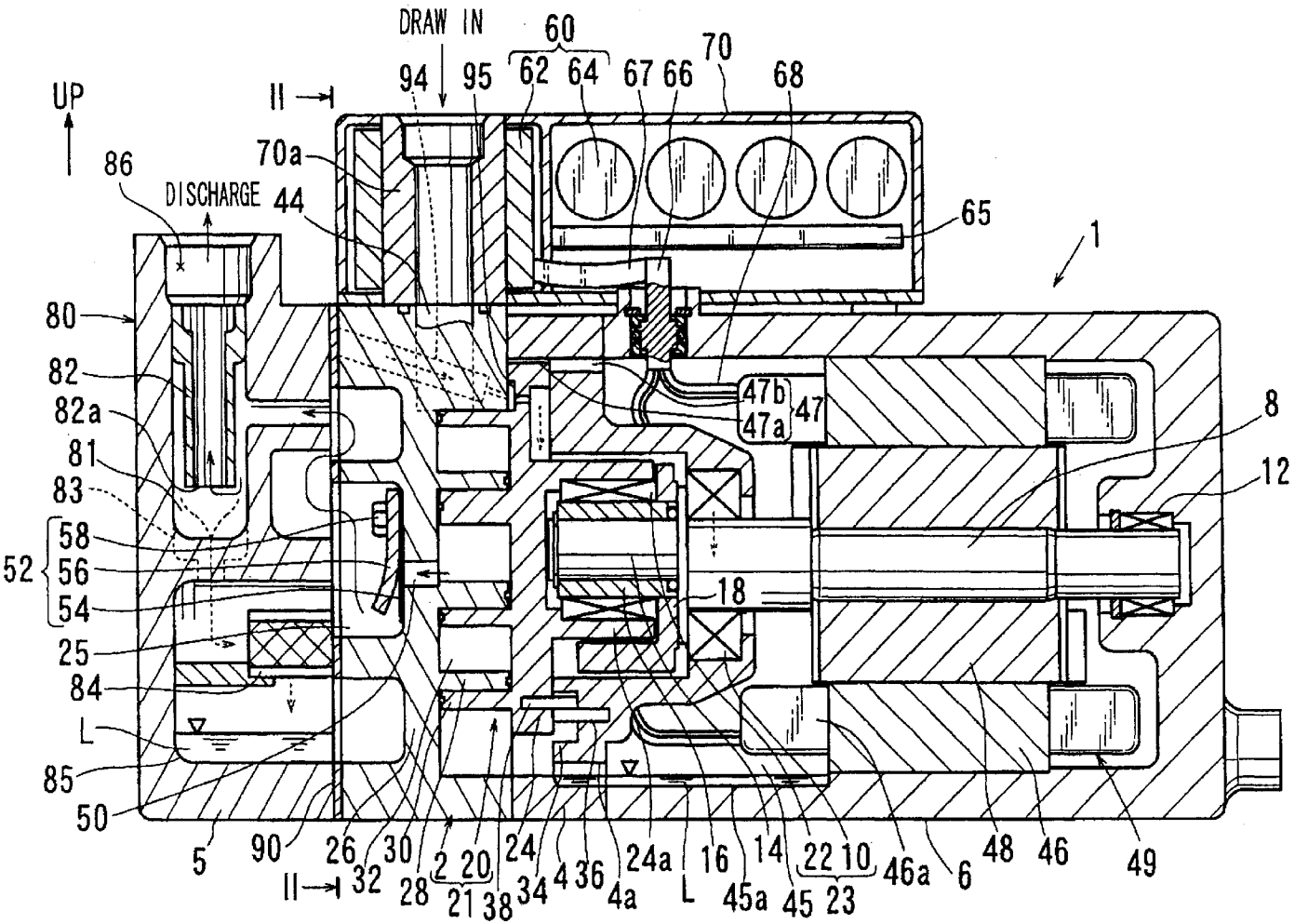
FIG. 1 is a vertical cross-sectional diagram of a representative scroll compressor.

In one embodiment of the present teachings, electrically driven compressors may include a compression mechanism arranged and constructed to draw in a refrigerant (or cooling medium or refrigerant), compress and highly pressurize the refrigerant, and then discharge the pressurized refrigerant. The compression mechanism preferably includes a drive shaft and an electric motor rotatably driving the drive shaft. The electric motor may be housed within a substantially sealed motor chamber. A bearing may rotatably support the drive shaft. A refrigerant flow channel preferably leads from a suction side of the compression mechanism to a discharge side of the compression mechanism. A communication path (connecting passage) preferably links the refrigerant flow channel to the motor chamber. A lubricating oil supply route may be defined between a discharge-side region of the refrigerant flow channel and the area proximal to the bearing. Preferably, a difference between the pressure at the discharge-side region of the refrigerant flow channel and the pressure at the area proximal to the bearing causes the lubricating oil to be supplied to the bearing via the lubricating oil supply route. A lubricating oil transfer route may be defined between the bearing and a suction-side region of the refrigerant flow channel. Preferably, a difference between the pressure at the area proximal to the bearing and the suction-side region of the compressor causes the lubricating oil, which was previously supplied to the bearing, to be transferred to the suction-side region. Optionally, a storage area may be provided to store lubricating oil that has lubricated the bearing before that lubricating oil is transferred via the lubricating oil transfer route to the suction-side region of the compressor.

In another embodiment of the present teachings, methods for circulating lubricating oil through electrically driven compressors are taught. Such methods may include supplying lubricating oil to a bearing based upon a difference between the pressure at a discharge-side region of a refrigerant flow channel and the pressure at the area proximal to the bearing. Further, the lubricating oil that has lubricated the bearing may be transferred to the suction-side region of the compressor based upon a difference between the pressure at the area proximal to the bearing and the suction-side region. In addition, after transferring the lubricating oil to the suction-side region of the compressor, the lubricating oil may be returned to the discharge-side region of the compressor due to refrigerant compression operation being performed by the compression mechanism. Optionally, after lubricating the bearing, the lubricating oil may be temporarily stored in an oil storage area that is defined proximal to the bearing.

Each of the additional features and teachings disclosed above and below may be utilized separately or in conjunction with other features and teachings to provide improved compressors and methods for designing and using such compressors. A representative example of the present invention, which example utilizes many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative example and the dependent claims may be combined in ways that are not specifically enumerated in order to provide additional useful embodiments of the present teachings.

The representative embodiment of the present teachings will be applied to a scroll compressor that raises the pressure of the introduced refrigerant by compressing it within a compression chamber that is defined between a fixed scroll and a movable scroll. The refrigerant is then discharged as compressed refrigerant.

A vertical cross section of an electrically driven scroll compressor 1 is shown in FIG. 1. Generally speaking, the compressor 1 includes a fixed scroll member 2, a center housing 4, a front housing 5, and a motor housing 6. These structures generally define the compressor main body. In FIG. 1, the left-side end face of center housing 4 is coupled to the right-side end face of fixed scroll member 2. The motor housing 6 is coupled to the right-side end face of the center housing 4. The front housing 5 is coupled to the left-side end face of the fixed scroll member 2. A drive shaft 8 is rotatably supported by the center housing 4 and the motor housing 6 via radial bearings 10 and 12. An eccentric (or offset) shaft 14, which is eccentric or offset relative to a drive shaft 8, is integrally formed on the end of the drive shaft 8 on the side of the center housing 4 (the left side in FIG. 1).

A bushing 16 is fitted onto the eccentric shaft 14 so as to integrally rotate with the eccentric shaft 14. A balancing weight 18 is disposed on the right-side end perimeter of the bushing 16, as shown in FIG. 1, so as to integrally rotate with the bushing 16. A movable scroll 20 is supported on the left-side periphery of the bushing 16 by a needle bearing 22 so as to face the fixed scroll 2 and rotate or orbit relative to the fixed scroll 2. The fixed scroll member 2 and the movable scroll 20 basically define a compression mechanism 21 for compressing a refrigerant. The movable scroll 20 has a platter-shaped substrate 24. A cylindrical boss 24*a* is disposed so as to protrude or project from the right-side surface of this substrate 24, as shown in FIG. 1. The needle bearing 22 and the radial bearing 10 generally define a bearing mechanism 23 of the movable scroll 20.

The fixed scroll member 2 includes a platter-shaped substrate 26. A spiral-shaped, e.g., involute-shaped, fixed scroll wall (lap) 28 is disposed so as to protrude or project from the right-side surface of this substrate 26, as shown in FIG. 1. Likewise, a spiral-shaped (e.g., involute-shaped) movable scroll wall (lap) 30 is disposed so as to protrude or project from the left-side surface of the substrate 24 of the movable scroll 20, as shown in FIG. 1. These scrolls 2 and 20 are preferably positioned such that the scroll walls 28 and 30 engage each other.

Thus, the substrate 26 and fixed scroll wall 28 of the fixed scroll 2 together with the substrate 24 and the movable scroll wall 30 of the movable scroll 20 define a crescent-shaped compression chamber (sealed space) 32. More specifically, the fixed scroll wall 28 slidingly contacts the movable scroll wall 30 at a plurality of sliding contact areas (or points). The movable scroll 20 revolves or orbits as the eccentric shaft 14 rotates. During this rotating or orbiting movement, the balancing weight 18 cancels the centrifugal force accompanying the revolution of the movable scroll 20. The eccentric shaft 14 rotates integrally with the drive shaft 8, the bushing 16 and the needle bearing 22, which are disposed between the eccentric shaft 14 and the boss 24*a* of the movable scroll 20. The eccentric shaft 14 is designed to transmit the rotational force of the drive shaft 8 to the movable scroll 20 as orbiting movement.

A plurality of (e.g., four) concave areas 34 are defined on the same circumferential line at uniform angular intervals on the left-side end face of the center housing 4, as shown in FIG. 1. A fixed pin 36 is secured to the center housing 4 and a movable pin 38 is secured to the substrate 24 of the movable scroll 20. The fixed pin 36 and the movable pin 38 are inserted into a concave area 34 and fastened. As the eccentric shaft 14 rotates, self-rotation of the movable scroll 20 is prevented by the concave areas 34, fixed pin 36, and movable pin 38. In other words, the concave areas 34, fixed pin 36, and movable pin 38 may define a self-rotation prevention mechanism for the movable scroll 20.

The substrate 26 of the fixed scroll 2 may include a reed-type discharge valve 52, which opens and closes a discharge opening 50. This discharge valve 52 has a reed valve member 54, which has a shape that corresponds to the discharge opening 50, and a valve retainer 56 for holding or retaining this reed valve member 54. The reed valve member 54 and the valve retainer 56 are secured to the substrate 26 of the fixed scroll 2 by means of a securing bolt 58. The discharge valve 52 is disposed within a discharge chamber 25 partially defined by the substrate 26 of the fixed scroll 2. Preferably, the reed valve member 54 opens and closes according to the difference in pressure between the compression chamber 32, which communicates with the discharge opening 50, and the discharge chamber 25. That is, when the pressure in the compression chamber 32 is higher than the pressure in the discharge chamber 25, the reed valve member 54 opens. Naturally, when the pressure in the compression chamber 32 is lower than the pressure in the discharge chamber 25, the reed valve member 54 closes. The valve retainer 56 is configured to regulate the maximum opening of the reed valve member 54.

An electric motor 49 is disposed within the motor housing 6. An inverter 60 for controlling the operation of the electric motor 49 is installed on the periphery of the housing of the compressor main body, which essentially consists of the fixed scroll 2, center housing 4, and motor housing 6. The inverter 60 may include, e.g., a switching element 62 that generates a relatively large amount of heat, and a condenser 64 that generates a relatively small amount of heat. The inverter 60 also may include an inverter case 70 for housing these configuration components in order to separate the high and low heat-generating components from each other. The inverter case 70 preferably contains a cylinder 70*a*, and the switching element 62 may be disposed on the periphery of this cylinder 70*a*. The inverter case 70 also may include a substrate 65 for installing the condenser 64. The cylinder 70*a* of inverter case 70 preferably communicates with a suction port 44. One end of the suction port 44 preferably communicates with the fixed scroll 2 while the other end of the suction port 44 preferably communicates with a refrigerant feedback pipe (not shown) of an external circuit.

The switching element 62 of the inverter case 70 may be electrically coupled to the electric motor 49 by means of three conducting pins 66 (only one of which is shown in the figure) and conductive wires 67 and 68. The conducting pins 66 preferably penetrate into the motor housing 6 and the inverter case 70. Electric current necessary for driving the electric motor 49 is supplied via these conducting pins 66 and conductive wires 67 and 68.

The location for connecting the conductive wire 68 with the stator coil 46*a* of the electric motor 49, which will be further described below, is preferably provided on the side of the electric motor 49 that faces the compressor mechanism 21. The inverter 60 is secured to the compressor housing (e.g., the center housing 4 and/or the motor housing 6). The location for connecting the electric motor 49 with the inverter 60 is preferably provided on the periphery of the casing along its diametric direction. In other words, this configuration produces a compact design with a much shorter axial length than a configuration in which the inverter (or a similar device) is disposed on the periphery along the axial direction. Moreover, the location for connecting the electric motor 49 with the inverter 60 is provided such that these components are close to each other. As a result, because the electric motor 49 can be connected to the inverter 60 over the shortest distance possible, a short connection member can be used. Consequently, material cost and weight can be reduced, and performance can be improved by minimizing voltage drops across the connection member.

A stator 46 is secured to the inner surface of the motor housing 6 and a rotor 48 is secured to the drive shaft 8. The drive shaft 8, stator 46, and rotor 48 generally define the electric motor 49. The stator 46 has a stator coil 46*a*, and by applying electric current to this stator coil 46*a*, the rotor 48 and drive shaft 8 rotate together. The electric motor 49 is preferably disposed within a substantially sealed motor chamber 45, which is defined within the motor housing 6 and center housing 4.

As the eccentric shaft 14 of the drive shaft 8 rotates, the movable scroll 20 revolves (orbits), and the refrigerant introduced from the suction port 44 (which is defined within the fixed scroll 2) flows into the space between the substrate 26 of the fixed scroll 2 and the substrate 24 of the movable scroll 20 from the edge of both scrolls 2 and 20. As the movable scroll 20 revolves, the movable pin 38 slides along the circumferential (peripheral) surface of the fixed pin 36. Then, when the eccentric shaft 14 further rotates, the movable scroll 20, which is installed on said eccentric shaft 14 via the needle bearing 22 so as to be able to rotate relative to the eccentric shaft 14, revolves around the central axis of the drive shaft 8 without rotating itself. As the movable scroll 20 revolves, the refrigerant that has been introduced through the suction port 44 flows into the compression chamber 32 and is guided to the center of the fixed scroll 2 while its pressure increases. Then, the pressurized (compressed) refrigerant flows into the discharge opening 50 that is defined in the center of the substrate 26 of the fixed scroll 2. That is, the discharge opening 50 communicates with the compression chamber 32 where the pressure reaches its highest value.

The center housing 4, which separates the compression mechanism 21 from the motor chamber 45, preferably includes a connecting passage 47. This connecting passage 47 may serve to connect the suction region within the refrigerant flow channel, which is defined within the compression mechanism 21 and leads from the suction port 44 to the discharge port 86, to the motor chamber 45. In other words, the opening through which the refrigerant enters communicates with the space 47*a* formed between the peripheral surface of the substrate 24 of the movable scroll 20 and the internal wall surface of the scroll-housing space for housing said substrate 24. The space 47*a* communicates with the motor chamber 45 via a communication hole 47*b*, which is defined in the center housing 4. Thus, the space 47*a* and the communication hole 47*b* generally define the connecting passage 47.

While the compressor 1 is operating, the connecting passage 47 always communicates with the refrigerant flow channel regardless of the position of the substrate 24 of the movable scroll 20, which revolves inside the scroll-housing space. Consequently, heat is transferred via the connecting passage 47 between the refrigerant introduced into the refrigerant flow channel and the refrigerant disposed within the motor chamber 45. That is, heat moves from the motor chamber 45, which is at a higher temperature, to the refrigerant flow channel, and this heat transfer cools the electric motor 49. Moreover, when a pressure difference occurs between the motor chamber 45 and the refrigerant suction region, refrigerant will flow between the motor chamber 45 and the suction region via the connecting passage 47 so as to equalize the pressure difference. Therefore, heat is transferred along with this refrigerant flow, and as a result, the electric motor 49 is cooled. Accordingly, the electric motor 49 is prevented from overheating.

Unlike known methods that utilize the motor chamber as the refrigerant channel, the present cooling methods and apparatus are based on so-called "stagnation cooling," which is not accompanied by a large refrigerant flow. The introduced refrigerant directly involved in this type of "stagnation cooling" is only a small portion of the total introduced refrigerant flowing through the refrigerant flow channel. Thus, the introduced refrigerant does not significantly raise or increase the temperature of the total introduced refrigerant. Therefore, an increase in the specific volume of the introduced refrigerant can be prevented, thereby eliminating the problem of reduced compression efficiency. Although the present embodiment uses a configuration in which the inverter 60 is cooled by the introduced refrigerant, the amount of heat generated by the inverter 60 is much less compared to the amount of heat that is generated by the electric motor 49. Therefore, the rise in the temperature of the introduced refrigerant caused by cooling the inverter 60 using said introduced refrigerant is small compared to the temperature rise that would be caused by cooling the electric motor 49 if all of the introduced refrigerant is supplied into the motor chamber 45. Therefore, compression efficiency is not reduced.

Moreover, in the present embodiment, because a low-temperature introduced refrigerant cools the electric motor 49, an improved cooling effect can be obtained than when using discharged refrigerant to cool the electric motor 49. Furthermore, the present configuration, which guides the introduced refrigerant to the motor chamber 45, does not require a sealing material to be disposed around the drive shaft 8, which drive shaft 8 transmits the drive force of the electric motor 49 to the compression mechanism 21. Therefore, a simple structure can be manufactured at a reduced cost.

The front housing 5 may include an oil separator 80 for separating the lubricating oil within the refrigerant that has been discharged from the discharge chamber 25. This oil separator 80 may utilize, e.g., a separation mechanism that relies upon centrifugal force to perform the oil separation. Thus, the oil separator 80 may generally include an oil separation chamber 81, a cylindrical member 82, a filter 84 installed below the cylindrical member 82, and a storage area (lubricating oil reservoir) 85 for temporarily storing the separated lubricating oil. A connection hole or passage 83 may be defined between the oil separation chamber 81 and the storage area 85 in order to allow lubricating oil to pass from the oil separation chamber 81 to the storage area 85. When the compressed refrigerant discharged from the discharge chamber 25 is introduced into the oil separator 80, as indicated by the curved, solid-line arrow in FIG. 1, the compressed refrigerant collides with the cylindrical member 82 in the oil separation chamber 81 and descends while circling around the cylindrical member 82. Therefore, the lubricating oil contained in the compressed refrigerant will separate due to centrifugal force and the lubrication oil will move, due to gravity, as indicated by the dotted-line arrow shown in FIG. 1.

Then, after the lubricating oil passes through the connection hole 83 and filter 84, the lubricating oil may be temporarily stored in the storage area 85. Meanwhile, the discharged refrigerant (from which the lubricating oil has been separated) moves from the opening 82*a* of the cylindrical member 82 to a discharge port 86, and then is transferred to a condenser (not shown) in an external circuit.

Figure 2:
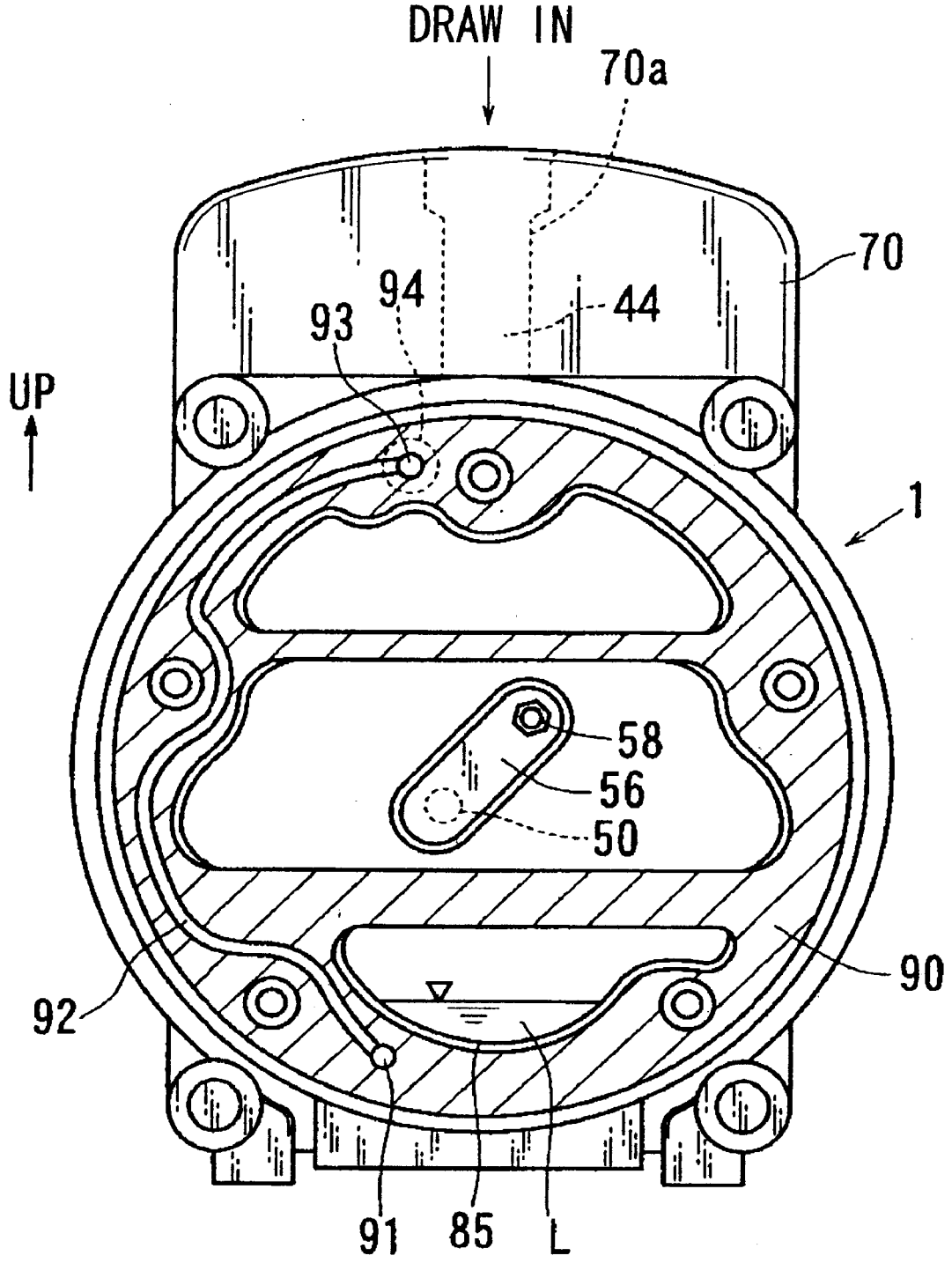
FIG. 2 is a perspective diagram taken along line II—II in FIG. 1.

A gasket 90 is preferably disposed between the right end face of the front housing 5 and the left end face of the fixed scroll 2. As shown in FIG. 2, a first oil supply hole 91, which communicates with the storage area 85, is defined near the bottom of this gasket 90, and a second oil supply hole 93 is defined near the top of the gasket 90. The first and second oil supply holes 91, 93 communicate with each other via an oil supply groove (lubricating oil supply passage) 92. A first oil supply route 94 extends from the oil supply hole 93, which is defined at an edge of the fixed scroll substrate 26, to the front side (the left side of the substrate 24 of the movable scroll 20 in FIG. 1) of the movable scroll 20. The first oil supply route 94 preferably has a throttled shape. That is, the area of its oil flow channel is smaller on the side of movable scroll 20 than on the side of the fixed scroll 2. Therefore, it is possible to prevent an unnecessary amount of lubricating oil from being supplied through this first oil supply route 94.

Figure 3:
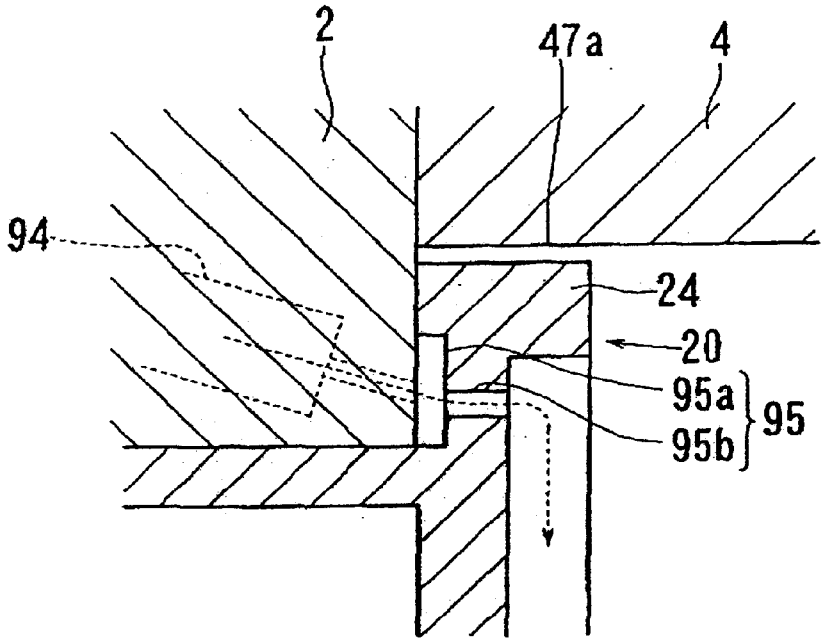
FIGS. 3 and 4 are partial cross-sectional diagrams illustrating the relative positions between the first and second oil routes at different rotational positions of a movable scroll.
Figure 4:
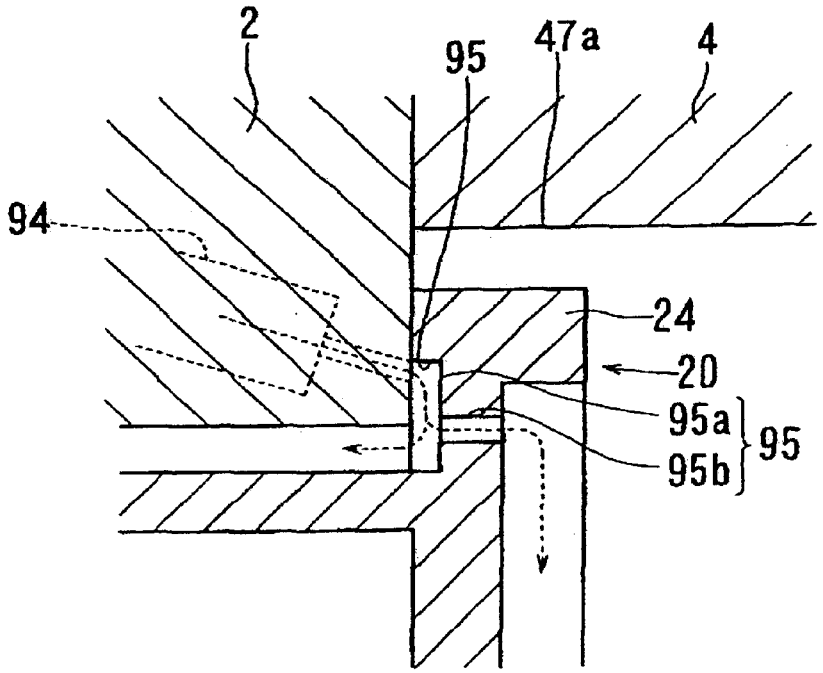

In addition, as shown in FIGS. 1, 3 and 4, a second oil supply route 95 may be defined on the portion of the perimeter of the substrate 24 of the movable scroll 20 that corresponds to the first oil supply route 94. The second oil supply route 95 extends through the movable scroll 20 from its front side (the left side of the movable scroll 20 in FIG. 1) to its back side (the right side of the movable scroll 20 in FIG. 1). Further, the second oil supply route 95 may include a concave area 95*a* on the upstream side and a hole 95*b* that extends from this concave area 95*a* to the downstream direction. That is, the second oil supply route 95 links the first oil supply route 94 to the back side (the right side of the substrate 24 of the movable scroll 20 in FIG. 1) of the movable scroll 20. Therefore, the oil storage area 85 of the front housing 5 communicates with the back side of the movable scroll 20 via the second oil supply route 95, the first and the second oil supply holes 91, 93, and the lubricating oil supply route, which includes the oil supply groove 92 and the first oil supply route 94.

Because the second oil supply route 95 is defined on the movable scroll substrate 24, the position of the second oil supply route 95 relative to the first oil supply route 94 changes as the movable scroll 20 rotates. However, the concave area 95*a* of the second oil supply route 95 is preferably designed so as to always communicate with the first oil supply route 94 regardless of the rotational position of the movable scroll 20.

The oil storage area 85, which is at the discharge pressure, has a higher pressure than the back side of the movable scroll 20, which is at the suction pressure. Consequently, the lubricating oil L stored in the storage area 85 is force-fed (pressure-fed) by this pressure difference to the back side of the movable scroll 20 via the lubricating oil supply route 91–95. The lubricating oil L stored in the storage area 85 will hereinafter be referred to as "the lubricating oil disposed in the discharge-side region."

Next, changes in position of the second oil supply route 95 relative to the first oil supply route 94 and resulting changes in the flow of the lubricating oil L during this process will be explained with reference to FIGS. 3 and 4.

The revolving motion of the movable scroll 20 can be expressed as vertical reciprocal movements with respect to FIG. 1. That is, while revolving, the movable scroll 20 is disposed in the position shown in FIG. 3 or FIG. 4. In the position shown in FIG. 3, the first oil supply route 94 communicates with the second oil supply route 95. Consequently, most of the lubricating oil, which has been supplied from the first oil supply route 94 to the front side (the left side in FIG. 3) of the substrate 24 of the movable scroll 20, is supplied to the back side (the right side in FIG. 3) of the substrate 24 via the second oil supply route 95. Of the lubricating oil that has been supplied to the front side of the substrate 24, a minute amount is supplied to the location where the fixed scroll 2 and movable scroll 20 are in sliding contact with each other via an extremely minute clearance between the fixed scroll 2 and movable scroll 20, i.e., at the periphery of the movable scroll wall 30.

In the position shown in FIG. 4, the first oil supply route 94 also communicates with the second oil supply route 95, and the concave area 95*a* of the second oil supply route 95 also communicates with the periphery of the movable scroll wall 30. As a result, the lubricating oil, which has been supplied from the first oil supply route 94 to the front side of the movable scroll substrate 24, is divided and supplied to (a) the back side of the movable scroll substrate 24 and (b) the periphery of the movable scroll wall 30. The lubricating oil L that has been supplied to the backside of the movable scroll substrate 24 preferably lubricates the bearing mechanism 23 (i.e., bearings 10 and 22). Meanwhile, the lubricating oil that has been supplied to the periphery of the movable scroll wall 30 preferably lubricates and seals the locations where the two scrolls are in sliding contact with each other.

The lubricating oil that has been force-fed or pressure-fed to the back side of the movable scroll substrate 24 via the lubricating oil supply route 91–95 and lubricates the bearing mechanism 23, or the excess lubricating oil that has been supplied to the bearing mechanism 23, falls due to gravity from the bearing mechanism 23 and is stored in an oil storage area 45*a* (concave area) defined on the bottom of the motor chamber 45.

A transfer route 4*a* (hereinafter referred to as "the lubricating oil transfer route") also is defined in the lower portion (one location) of the center housing 4, which lower portion corresponds to the oil storage area 45*a*. This transfer route 4*a* links the storage area 45*a* of the motor chamber 45 to the suction region (hereafter also referred to as "the suction-side region") of the compression mechanism 21. When the lubricating oil in the storage area 85 is being supplied to the backside of the movable scroll 20, a portion of the discharged refrigerant is also carried along through the lubricating oil supply route 91–95. Consequently, the pressure at the storage area 45*a* becomes higher than the pressure at the suction region, which is at the introduced refrigerant pressure.

Therefore, the lubricating oil L, which has been temporarily stored in the oil storage area 45*a*, is transferred (pressure-fed) by the pressure difference to the suction side region or the suction port 44 of the compression mechanism 21 via the transfer route 4*a*. Then, after passing through the compression chamber 32, the lubricating oil is transferred from the discharge opening 50 to the oil separator 80, together with the refrigerant that has been highly pressurized in the compression chamber 32, and is discharged. Thus, the first oil supply hole 91 may serve as a first end of the lubricating oil supply route 91–95, which first end communicates with the discharge port 86 (the discharge side region), while the second oil supply route 95 may serve as a second end of the lubricating oil supply route 91–95, which second end communicates with the suction port 44 (the suction side region). The lubricating oil contained in the discharged refrigerant is again separated by the oil separator 80 and force-fed (pressure-fed) to the back side of the movable scroll 20 via the lubricating oil supply route 91–95.

In this way, the lubricating oil contained in the discharged, compressed refrigerant is circulated to and from the backside of the movable scroll 20. The capacity of the oil storage area 45*a* and the size of the refrigerant flow channel area of the transfer route 4*a*, etc. can be appropriately selected according to the volume of lubricating oil that will be stored in the storage area 45*a*.

In scroll compressors having the above-described configuration, when the electric motor 49 is driven, the refrigerant returning from the evaporator (not shown) of an external circuit is guided into the compressor 1 via the cylinder 70*a* and suction port 44. During this suction process, the refrigerant passing through the cylinder 70*a* cools the inverter 60. Then, this refrigerant is compressed and pressurized in the compression chamber 32 as the movable scroll 20 revolves, and is then transferred as discharged, compressed refrigerant via the discharge port 86 to the condenser (not shown) of an external circuit.

As explained above, the present embodiment can effectively circulate and utilize the lubricating oil disposed in the discharge-side region, which has been separated from the discharged refrigerant by the oil separator 80.

Moreover, because the lubricating oil L is supplied to the bearing mechanism 23 (i.e., bearings 10, 22) via the lubricating oil supply route (e.g., the oil supply holes 91 and 93, oil supply groove 92, first oil supply route 94, and second oil supply route 95), the lubrication characteristics and durability of the bearing mechanism 23 can be improved.

Furthermore, the lubricating oil that has been supplied to the bearing mechanism 23 (i.e., bearings 10, 22) is transferred (pressure-fed) by the pressure difference from the oil storage area 45*a* to the suction region of the compression mechanism 21 via the lubricating oil transfer route (i.e., transfer route 4*a*). Then, this lubricating oil is again supplied, due to the pressure difference, to the bearing mechanism 23 (i.e., bearings 10, 22) through the lubricating oil supply route (i.e., elements 91–95). In this way, a convenient lubricating oil circulation circuit that utilizes refrigerant pressure differences can be realized.

Moreover, because the lubricating oil that falls due to gravity from the bearing mechanism 23 (i.e., bearings 10, 22) is temporarily stored in the oil storage area 45*a*, the stored lubricating oil can be reliably transferred to the suction side region or the suction port 44 of the compression mechanism 21 via the lubricating oil transfer route (transfer route 4*a*).

The present teachings are not limited to the above-described representative embodiment, and a variety of applications and modifications are appropriate. For example, the present embodiment can be modified as further described below.

(A) In the representative embodiment, the lubricating oil that has been separated from the discharged refrigerant by the oil separator 80 is supplied to the bearing mechanism 23. However, it is also possible to use, for example, a configuration in which the lubricating oil stored in a storage area different from the oil separator 80 is supplied to the bearing mechanism 23 using the difference in pressure between the discharged refrigerant and region proximal to the bearing mechanism 23.

(B) In the representative embodiment, the lubricating oil stored in the storage area 45*a* of the motor chamber 45 is transferred to the suction region of the compression mechanism 21 via the transfer route 4*a*. However, it is also possible to use, for example, a configuration in which the lubricating oil is transferred from the storage area 45*a* to the low-pressure side of the compression chamber 32, as long as this pressure is lower than the pressure in the storage area 45*a*.

(C) In the representative embodiment, a transfer route 4*a* is defined in the lower portion (one location) of the center housing 4. However, in addition to this transfer route 4*a*, it is also possible to provide transfer routes of the same kind in the radial directions of the compressor main body. That is, a plurality of transfer routes can be defined in the radial directions of the compressor main body. Such a configuration, with at least one transfer route positioned in the lower portion of the center housing 4, can be utilized in situations in which the compressor is installed in a slightly tipped or inclined orientation. Also, by providing multiple transfer routes in the radial direction of the compressor main body, the transfer routes defined in the lower portion can be used for transferring the lubricating oil and the other transfer routes can be used for transferring the refrigerant. Thus, excessive rises in the pressure on the side of the storage area 45*a* can be prevented.

(D) In the representative embodiment, a scroll compressor was described. However, the present teachings are also applicable to other types of compressors, e.g., reciprocal compressors that compress the refrigerant by reciprocating a piston inside a cylinder bore.

What is claimed is:

1. An electrically driven compressor comprising:

a compression mechanism arranged and constructed to draw in a refrigerant, compress and highly pressurize the refrigerant, and then discharge the pressurized refrigerant, the compression mechanism comprising a drive shaft, wherein a refrigerant flow channel is defined between a suction side of the compression mechanism and a discharge side of the compression mechanism, an electric motor rotatably driving the drive shaft, a bearing rotatably supporting the drive shaft, a motor housing defining a substantially sealed motor chamber, wherein the electric motor is disposed within the motor chamber, a communication path linking the refrigerant flow channel to the motor chamber, a lubricating oil supply route defined between a discharge-side region of the refrigerant flow channel and an area proximal to the bearing, the lubricating oil supply route being arranged and constructed so that a difference between the pressure at the discharge-side region of the refrigerant flow channel and the pressure at the area proximal to the bearing urges lubricating oil towards the bearing via the lubricating oil supply route, an oil storage area defined proximal to the bearing and communicating with the lubricating oil transfer route, the oil storage area being arranged and constructed to store lubricating oil that has lubricated the bearing, and a lubricating oil transfer route defined between the oil storage area and a suction-side region of the refrigerant flow channel, the lubricating oil transfer route being arranged and constructed so that a difference between the pressure at the oil storage area and the pressure at the suction-side region of the refrigerant flow channel urges lubricating oil from the oil storage area toward the suction-side region of the refrigerant flow channel.

2. A method for circulating lubricating oil through the electric compressor having a compression mechanism arranged and constructed to draw in a refrigerant, compress and highly pressurize the refrigerant, and then discharge the pressurized refrigerant, the compression mechanism comprising a drive shaft and a bearing rotatably supporting the drive shaft, wherein a refrigerant flow channel is defined between a suction side of the compression mechanism and a discharge side of the compression mechanism, comprising:

pressure-feeding lubricating oil to the bearing based upon a difference between the pressure at the discharge-side region of the refrigerant flow channel and the pressure at the area proximal to the bearing, storing the lubricating oil that has lubricated the bearing in an oil storage area defined proximal to the bearing, pressure-feeding lubricating oil from the oil storage area to the suction-side region of the refrigerant flow channel based upon a difference between the pressure at the oil storage area and the pressure at the suction-side region of the refrigerant flow channel, and returning the lubricating oil from the suction-side region of the refrigerant flow channel to the discharge-side region of the refrigerant flow channel by operating the compression mechanism.

3. An electrically driven compressor comprising:

a compression mechanism arranged and constructed to draw in a refrigerant, compress and highly pressurize the refrigerant, and then discharge the pressurized refrigerant, the compression mechanism comprising a drive shaft, a movable scroll mounted on the drive shaft and a fixed scroll arranged and constructed to cooperate with the movable scroll, an electric motor rotatably driving the drive shaft, a bearing rotatably supporting the drive shaft, and a lubricating oil route arranged and constructed to transfer lubrication oil from a discharge-side region of the compression mechanism to a suction-side region of the compression mechanism via the bearing so as to lubricate the bearing as the refrigerant is compressed by the compression mechanism, wherein the lubricating oil route includes an oil supply route defined in the movable scroll, so that the lubrication oil is transferred from the discharge-side region to the bearing via the oil supply route.

4. An electrically driven compressor as in claim 3, wherein the lubricating oil route has a first end and a second end that respectively communicate with the discharge-side region and the suction-side region of the compression mechanism, wherein the lubricating oil route is arranged and constructed so that the lubrication oil flows from the discharge-side region to the suction-side region via the bearing due to a difference in pressure between the discharge-side region and an area proximal to the bearing and difference in pressure between the area proximal to the bearing and the suction-side region.

5. An electrically driven compressor as in claim 4, wherein:

the lubricating oil route further includes a lubricating oil transfer route defined between the bearing and a suction-side region of the compression mechanism, wherein a difference between the pressure at the area proximal to the bearing and the pressure at the suction-side region of the compression mechanism pressure-feeds the lubricating oil that lubricated the bearing to the suction-side region of the compression mechanism.

6. An electrically driven compressor as in claim 4, further including an oil separator communicating with the discharge-side region of the compression mechanism, the oil separator being arranged and constructed to separate the lubricating oil from compressed refrigerant that has been discharged from the compression mechanism.

7. An electrically driven compressor as in claim 4, further including an oil storage area defined proximal to the bearing, the oil storage area being arranged and constructed to store lubricating oil that lubricated the bearing before the stored lubricating oil is transferred to the suction-side region of the compression mechanism.

8. A method for circulating lubricating oil within an electrically driven compressor, the compressor having a compression mechanism that is driven by a drive shaft, an electric motor rotatably driving the drive shaft, and a bearing rotatably supporting the drive shaft, the method comprising:

generating a pressure differential between a discharge port of the compressor and a suction port of the compressor, thereby causing lubricating oil to move via a lubricating oil route from the discharge side region to the suction side region, pressure-feeding the lubricating oil from the suction port to an area proximal to the bearing via a communication path, whereby the bearing is lubricated, and pressure-feeding the lubricating oil via a lubricating oil transfer route defined between the area proximal to the bearing and a suction-side region of the compression mechanism due to a difference between the pressure at the area proximal to the bearing and the pressure at the suction-side region of the compression mechanism.

9. A method as in claim 8, wherein the pressure differential along the lubricating oil route is generated due to refrigerant that is compressed by the compression mechanism.

10. A method as in claim 9, wherein a first end of the lubricating oil route communicates with the discharge port and the second end of the lubricating oil route communicates with the suction port.

11. A method as in claim 10, further including separating the lubricating oil from compressed refrigerant that has been discharged from the compression mechanism.

12. A method as in claim 10, further including storing the lubricating oil that lubricated the bearing before the stored lubricating oil is transferred to the suction-side region.

13. A method for circulating lubricating oil within an electrically driven compressor, comprising:

separating lubricating oil from compressed refrigerant in an area proximal to and communicating with a discharge port of the compressor, transferring the separated lubricating oil to a bearing that rotatably supports a drive shaft using a pressure-differential between the area proximal to and communicating with the discharge port and an area proximal to the bearing, wherein the bearing is lubricated with the lubricating oil, temporarily storing the lubricating oil that has lubricated the bearing, transferring the lubricating oil that has been temporarily stored to an area proximal to and communicating with a suction port of the compressor using a pressure-differential between the area proximal to the bearing and the area proximal to and communicating with the suction port, drawing the lubricating oil into a compression chamber of the compressor together with refrigerant supplied via the suction port and compressing the refrigerant and lubricating oil, and discharging the compressed refrigerant to the area proximal to and communicating with the discharge port.

14. A method as in claim 13, further comprising temporarily storing the lubricating oil separated from the compressed refrigerant before transferring the separated lubricating oil to the bearing.

15. An electrically driven compressor, comprising:

means for separating lubricating oil from compressed refrigerant in an area proximal to and communicating with a discharge port of the compressor, means for transferring the separated lubricating oil to a bearing that rotatably supports a drive shaft using a pressure-differential between the area proximal to and communicating with the discharge port and an area proximal to the bearing, wherein the bearing is lubricated with the lubricating oil, means for temporarily storing the lubricating oil that has lubricated the bearing, means for transferring the lubricating oil that has been temporarily stored to an area proximal to and communicating with a suction port of the compressor using a pressure-differential between the area proximal to the bearing and the area proximal to and communicating with the suction port, means for drawing the lubricating oil into a compression chamber of the compressor together with refrigerant supplied via the suction port and compressing the refrigerant and lubricating oil, and means for discharging the compressed refrigerant to the area proximal to and communicating with the discharge port.

16. An electrically driven compressor as in claim 15, further comprising means for temporarily storing the lubricating oil separated from the compressed refrigerant before transferring the separated lubricating oil to the bearing.

* * * * *